United States Patent [19]

Fejmert

[11] Patent Number: 4,599,053

[45] Date of Patent: Jul. 8, 1986

[54] DISPLACEMENT PUMP FOR ABRASIVE AND DIFFICULT TO PUMP FLUIDS

[76] Inventor: Bernhard Fejmert, Nordostpassagen 19, S-413 11 Göteborg, Sweden

[21] Appl. No.: 732,000

[22] PCT Filed: Sep. 5, 1983

[86] PCT No.: PCT/SE83/00324

§ 371 Date: May 2, 1985

§ 102(e) Date: May 2, 1985

[87] PCT Pub. No.: WO85/01085

PCT Pub. Date: Mar. 14, 1985

[51] Int. Cl.[4] ..... F04B 19/02

[52] U.S. Cl. ..... 417/437; 417/468; 417/472; 417/900

[58] Field of Search ..... 417/437, 460, 468, 472, 417/473, 900, 478

[56] References Cited

U.S. PATENT DOCUMENTS

| | | | |
|---|---|---|---|
| 1,527,545 | 2/1925 | Emmerling et al. | 417/460 |
| 2,721,027 | 10/1955 | Schwartz | 417/478 |
| 3,228,340 | 1/1966 | Hubbard | 417/900 X |
| 3,429,272 | 2/1969 | Wilhite | 417/900 X |

FOREIGN PATENT DOCUMENTS

| | | | |
|---|---|---|---|
| 68490 | 11/1975 | Australia | 417/900 |
| 36705 | 2/1934 | Netherlands | 417/900 |

*Primary Examiner*—Leonard E. Smith

[57] ABSTRACT

A displacement pump intended in particular for wearing and difficult to pump fluids such as concrete. It consists of a pump chamber (22) formed from a first tubular slide component (2) and a second similarly tubular slide component (4), with the second slide component being movably supported outside the first sliding component. As the sliding components move forwards and backwards in relation to each other, a cycle of compression and suction strokes will be produced. Inside the pump chamber (22) there is arranged a sleeve (6) of a soft, elastic material such as rubber covering the walls of the chamber and the contact surface between the two slides (2, 4). The sleeve (6) is free along essentially the entire distance between its attachment points (3, 5). It has a length in its unactuated state which corresponds essentially to the distance between the points of attachment when the slide components (2, 4) adopt their most compressed position so that the sleeve, which is capable of elastic extension, will be subjected to extension with elastic stretching only when the slide components are working.

3 Claims, 2 Drawing Figures

DISPLACEMENT PUMP FOR ABRASIVE AND DIFFICULT TO PUMP FLUIDS

TECHNICAL FIELD

The present invention relates to a displacement pump intended in particular for abrasive and difficult to pump fluids such as concrete consisting of a pump chamber formed from a first tubular slide component and a second similarly tubular slide component, with the second slide component being supported outside the first slide component in such a way that the second slide component can be moved forwards and backwards outside the first slide component, said slide components being so arranged as to move forwards and backwards in relation to each other so as to produce a cycle of compression and suction strokes, with a sleeve of a soft elastic material such as rubber being arranged inside the pump chamber and covering the walls of the chamber and the contact surface between the two slides, and with lines for the supply and removal respectively of the medium to be pumped being connected to the chamber.

BACKGROUND

Displacement pumps generally exhibit certain characteristics which make them less suited to certain applications, although the displacement pump may be preferred in view of other of its characteristics. One such characteristic, which makes most displacement pumps difficult to use with aggressive fluids and fluids with particles mixed in or in suspension, expecially those which cause wear, is the fact that most displacement pumps include parts which are required to move in relation to each other during sealing. The situation becomes even more problematical if the fluid being pumped has a tendency to cake and to become attached to the walls of the pump. Examples of fluids of this kind which are difficult to pump are asphalt, concrete, sewage, molasses and paper pulp. Experiments have been conducted in an attempt to modify displacement pumps for pumping of this kind by fitting scraper rings or by manufacturing the component parts of the pump from a soft material such as rubber. In spite of the fact that these experiments have produced excellent pump designs in many cases, the need still remains for further types of pumps suitable for particularly difficult fluids, amongst which concrete can be mentioned, which has a viscous consistency, is extremely abrasive and is difficult to remove once it has become baked and has assumed a solid state.

TECHNICAL PROBLEM

It may thus be established that it has been possible only to a limited extend to produce pumps of the displacement type which are also suitable for use with difficult to pump fluids and at high pressures without leakage occurring.

SOLUTION

The aforementioned problems are solved by a pump in which the sleeve is free along essentially the entire distance between its attachment points and which has a length in the unactuated state which corresponds essentially to the distance between the points of attachment when the slide components adopt their most compressed position so that the sleeve, which is capable of elastic extension, will be subjected to extension with elastic stretching only when its slide components are working.

ADVANTAGES

A pump of the indicated type is proposed by the invention, which has a free, smooth-surfaced bore, which reduces the risk of blocking and facilitates cleaning.

BRIEF DESCRIPTION OF DRAWINGS

In the accompanying drawings are illustrated two embodiments of the invention.

BEST MODE OF CARRYING OUT THE INVENTION

Figure 1:
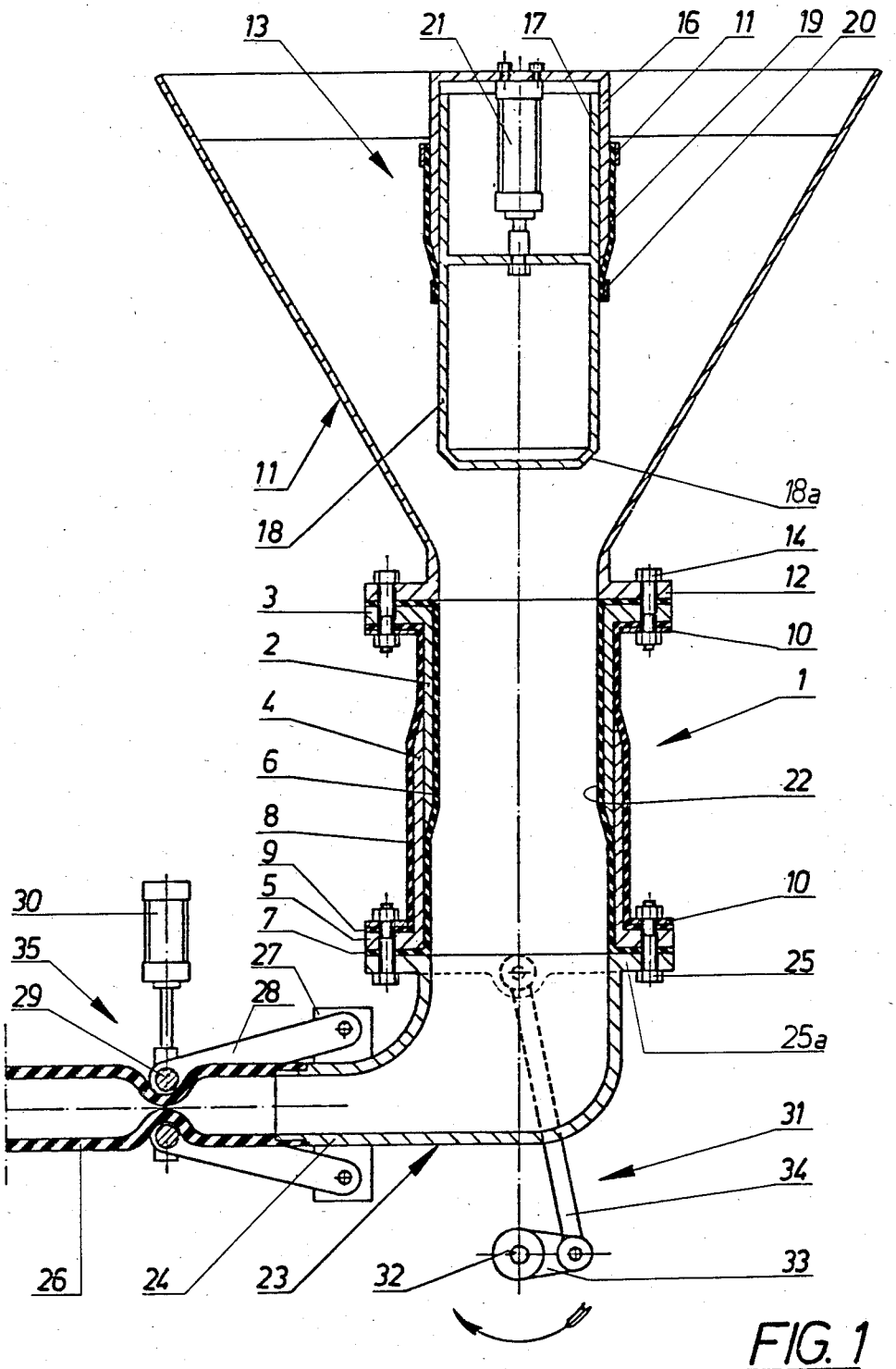
FIG. 1 shows a sectional view of the first embodiment.

The embodiment shown in FIG. 1 comprises a pump unit 1, which constitutes that part of the pump which performs the pumping work. The pump unit comprises an inner tubular slide 2 with a flange 3 and an outer tubular slide 4 with a flange 5. The two slides 2 and 4 are cylindrical and are capable of axial movement in relation to each other at contact surfaces. The surfaces of the slides which correspond to the contact surfaces taper in a conical fashion at the free ends of the slides, as may be appreciated from the Figure. Inside the slides there is arranged a gaiter 6 of an elastic, stretchable material, preferably synthetic rubber. The gaiter 6 is also tubular and follows first the inner surface of the slide 2 and then the inner surface of the slide 4 and is provided at its ends with flange components 7 which are held in contact with the flanges 3 and 5 respectively of the slides. Outside the slides is a further sleeve 8 which first follows the outside of the slide 2 and then the outside of the slide 4. The outer sleeve 8 also has flange components 9 which are held against the flanges 3 and 5 by means of washers 10.

The flange 3 for the inner slide 2 supports a feed funnel 11. It does this by means of a flange 12 which constitutes the end of the actual funnel component which widens out towards the top. A number of screws 14 are provided for holding together the flanges 3 and 12, and as may be appreciated from the drawing the flange 7 of the inner sleeve 6 is held between the flanges 3 and 12. In the mouth of the funnel component is a cross-stay 15 which supports a fixed slide component 16 for an inlet valve 13. The fixed slide component exhibits an internal bore 17 in which a moving slide 18 can run. At its end which faces the inner slide 18 the outer slide tapers in a conical fashion, and this joint is covered by an elastic, stretchable sleeve 19, preferably of synthetic rubber. This is secured by means of ring clamps 20. Fixed inside the slides is a pneumatic or hydraulic power unit 21, the cylinder of which is attached to the fixed slide component 16 and the piston rod of which is fixed to the moving slide component 18. With the help of the power unit 21 the moving slide component can be moved up and down between the open position shown in FIG. 1, in which the inlet to the pump chamber 22 formed inside the pump unit 1 is open, and a position in which one edge 18*a* of the moving slide component 18 is in contact with the funnel component and closes the inlet to the pump chamber 22.

To the flange 5 of the pump unit 1 is attached a connection piece 23 with an outlet stub 25*a*, and here too a number of screws 25 are provided for the purpose of holding the components together, providing clamping of the flange 7 of the sleeve 6 between the flanges 5 and 25*a*. The outlet stub 24 is followed by a hose 26 of soft, elastic material for the transport of the fluid being pumped. The stub also exhibits by means of a bearing box 27 two pivoting arms 28 which support the pressure applying components 29. One of the arms 28 is connected to the cylinder of a power unit 30, and the other is connected tot he piston rod. As the piston rod moves over its stroke the arms 28 will be caused to move towards and away from each other, and the pressure application components will alternately pinch the hose 26 as shown in FIG. 1 and release it, providing free passage.

The intention when the pump is working is for the outer slide 4 to move up and down in relation to the inner slide 2. In order to provide this movement there is arranged a crank mechanism 31 with a crank shaft 32, a crank arm 33 and a connecting rod 34. The connecting rod 34 is pivotally mounted on the outlet stub 24, and rotation of the crank shaft will thus cause the outlet stub to move up and down, with this movement being followed by the outer slide 4. The hose 26 must, therefore, permit this movement to take place. The outlet valve 35 is supported by the outlet stub and accompanies the movement.

In the second embodiment there is to be found a pump unit which is of the same kind as the pump unit in FIG. 1; it is even identified in a similar fashion by the reference designation 1. One difference, however, is that a connecting rod 36 to a drive means 37, which is of the same kind as the drive means 31 in FIG. 1, is supported on the inner, upper slide component instead of on the outer, lower slide component. In the second embodiment the pump chamber 22 is closed at one end by means of a cover 38. At the lower end in this case, too, there is a connecting piece, identified by the reference designation 39. This exhibits both an inlet stub 40 and an outlet stub 41, which are connected by two hoses 42 and 43 respectively. Each of the stubs supports a valve means which is of the same kind as the valve means 35 in FIG. 1 and which have been given the reference designations 44 and 45 on the inlet and outlet sides respectively.

When the pump unit is working one of the slide components is caused to move forwards and backwards in relation to the other slide component. Thus, in the embodiment in accordance with FIG. 1, the outer slide component 4 will move up and down together with the connecting piece 24 and a part of the hose 26. This will be accompanied by sliding at the contact surface between the two slide components, and these are permanently lubricated by filling the space between the two sleeves 6 and 8 with a lubricant.

When the slide components are working the sleeves must adapt to the varying length. This is assumed to take place by matching the lenght of the sleeves to the shortest length during the stroke, when they should be unextended or extended only to an insignificant degree. As the slide components are drawn apart, it will thus be necessary for the elastic material in the sleeves to be tensioned, which is entirely possible for a reasonable length of stroke and by selecting an extensible, elastic rubber for the sleeves. The advantage gained in this way is that the walls of the pump chamber exhibit a completely smooth surface at all times and provide a smooth, unrestricted passage at all times during the working cycle.

As an alternative, however, the sleeves may be so dimensioned as to be more or less too long at the shortest length during the stroke, whilst at the longest length they are stretched to a certain degree or are stretched only until they are smooth. Between the latter state and the first state described there is thus an infinite number of possible adjustments to provide different degrees of stretching for the sleeves when extended to their greatest length. A certain amount of compression must be provided in order to permit a length of stroke to be achieved which cannot be accommodated in the stretching capacity of the material. Compression which results in the formation of folds inside the pump chamber may be advantageous in certain circumstances, as it may cause the peeling off of any layers which may have been formed on the walls of the pump chamber by a material which exhibits this tendency. Stretching also has a similar effect.

It is also possible to select different lengths for the outer and the inner sleeves. The construction of the outer sleeve has no significance for water penetration, and its principal task is to protect the bearing surface between the two sliding components from becoming contaminated by dirt and against loss of lubricant.

As the aforementioned movements take place the volume of the pump chamber 22 will increase and reduce periodically. The fluid itself can be said to constitute a piston inside the pump chamber, which is particularly noticeable in the case of viscous fluids. The flow must be controlled, however, if effective pumping is to be achieved through the pump. In the embodiment in accordance with FIG. 1 the inlet is controlled via the valve means 13. The fluid which is to be pumped is held in the funnel 11. As the slide components are drawn apart, i.e. into the suction position, the lower slide component 18 is held in its upper position, allowing the material to pass down into the pump chamber as it increases in volume. When the lower slide component 4 begins to turn the power unit 21 is actuated causing the slide component 18 in the valve to move downwards whilst the sleeve 19 is extended. The adjustment of its length is covered on the whole by what has already been said about the sleeves 6 and 8. Thus the edge 18*a* will produce a seal against the funnel 11, and the material inside the pump chamber cannot now be forced upwards. The up and down operation of the slide component 18 in time with the strokes of the pump also produces the effect of a ram for feeding the fluid downwards. The embodiment in accordance with FIG. 1 is, in fact, primarily intended for viscous bulk materials, such as bulk concrete with a low water content. The bulk material is simply poured down into the funnel 11 in this case, and the constant reciprocating movement of the slide component 18 will provide the mechanical feed of the bulk material down into the pump chamber. Congestion or bridging in the funnel can be avoided in this way.

The fluid will thus be prevented from flowing upwards on the volume reduction stroke, and must pass out through the connection piece 23 and onwards via the hose 26. The valve 35 will have been caused to open by the pressure application components 29 having been withdrawn from the hose by means of the power unit 30. The fluid will thus be forced out through the hose 26 and can be delivered via the hose to the intended position. On the suction stroke, on the other hand, the pressure application components 29 will pinch the hose 26, and suction must take place past the open valve 13.

Figure 2:
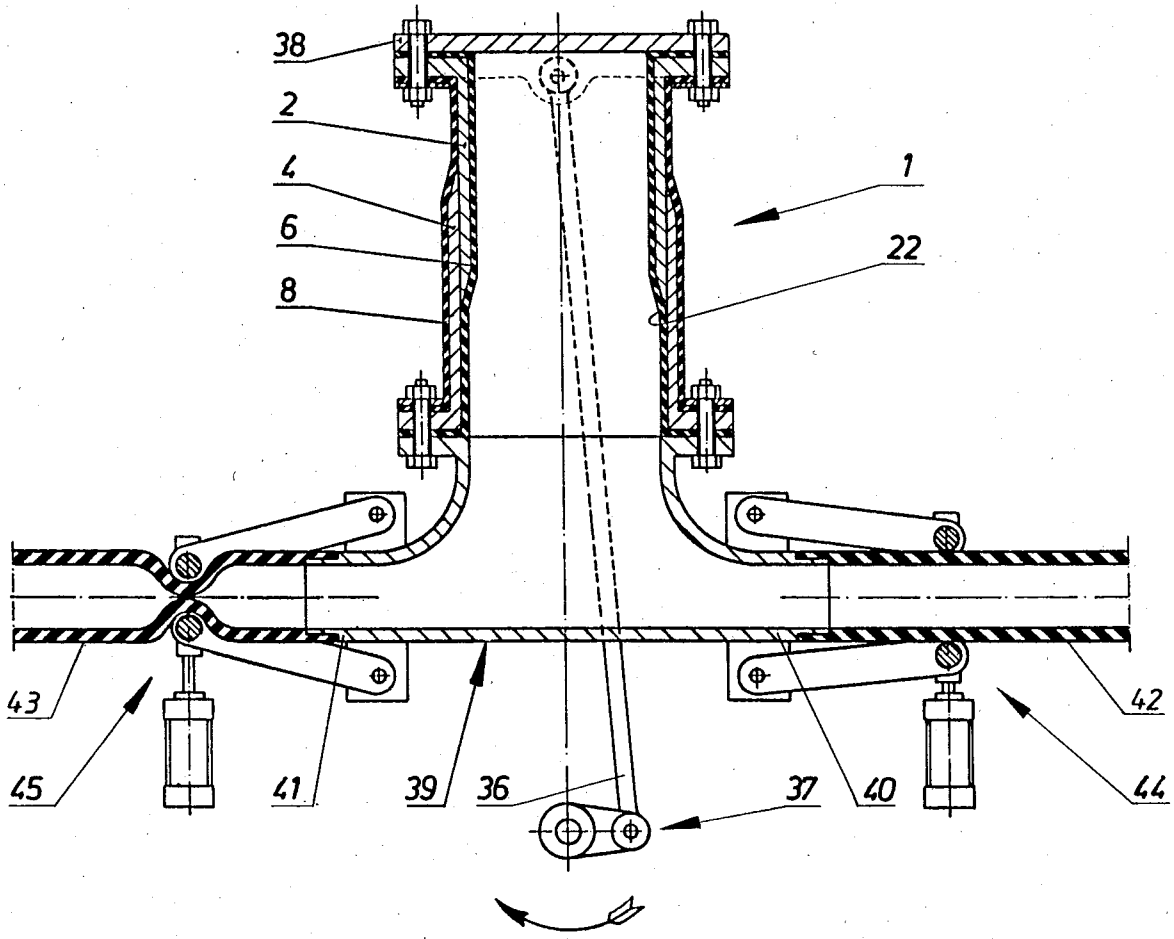
FIG. 2 shows a sectional view of the second embodiment.

The embodiment in accordance with FIG. 2 is intended for more easily pumped bulk fluids which it is wished to suck up or remove from a vessel. For this purpose the end of the hose 42 is positioned respectively at the suction point or at the outlet from the vessel, whilst the hose 43 is positioned at the point to which it is wished to pump the fluid. On the suction stroke the inner, upper slide component 2 is caused to move upwards whilst the valve 44 is open and the valve 45 is closed, as shown in FIG. 2. In this way the fluid is sucked in through the hose 42 and into the pump chamber 22 until the greatest volume has been reached. As the slide component reverses, the power unit for the valves will be actuated in such a way as to cause the valve 44 to close and the valve 45 to open. During the following compression stroke the fluid will be forced out through the hose 43.

Coordination of the movement of the various components is provided in the embodiment shown by means of some kind of programming unit. For example, the shaft 32 can be driven by an electric motor, said shaft at the same time driving a cam disc which supplies impulses to valves which permit the pressurized fluid to pass to the power units for the actuation of the various valves. In this way the work of the valves is coordinated by the strokes of the pump chamber. Other types of drive system are also conceivable, and the valves may be driven in an entirely mechanical fashion from the shaft 32, for example. As an alternative it is conceivable to cause the pump unit 1 to be driven by power units, either pneumatic or hydraulic and similar to those used for actuating the valve. This requires the use of a programming unit to coordinate the movements of the various power units.

It is also possible in a conventional fashion to cause the valves to be actuated automatically by means of the alternating pressures produced by the work of the pump. However, the design of the pump is suitable for fluids which are particularly difficult to pump, as stated by way of introduction, and automatic valves may be subject to problems of blocking under these conditions. In the embodiment shown no mechanical components or surfaces which move against each other are present in the areas containing the fluid, which is a highly advantageous situation. The pump is very easy to clean. This means that any hoses which are present can be removed easily for washing down, with the result that the need for the complicated dismantling of valves is eliminated. Once the hoses have been removed, each of the connecting pieces is easily accessible for washing down.

I claim:

1. A displacement pump, in particular for an abrasive and difficult to pump medium such as concrete, comprising a pump chamber formed from a first stationary tubular slide means and a second movable tubular slide means, a supply means for the medium connected to the first slide means, outlet means for the medium connected to the second slide means, said second slide means being in a sliding relationship supported by the first slide means, driving means connected to the second slide means for moving the second slide means forwards and backwards relative to the first slide means so as to produce a cycle of compression and suction strokes, wherein the walls of the two tubular slide means are enclosed between an inner sleeve of a soft, elastic material such as rubber provided inside the pump chamber covering the walls of the chamber and a contact surface between the two slide means and an outer sleeve of a flexible, elastic material such as rubber provided around the two slide means so that they are enclosed between said inner and outer sleeves in such a manner that the contact surface between the two slide means is fully enclosed, and a lubricant placed inside a space between the sleeves, said sleeves being free from attachment to said walls along essentially the entire distance between attachment points of said sleeves, each attachment point being positioned at a distance from the contact surface between the two slide means, and said sleeves having a length which corresponds essentially to the distance between the points of attachment when the two slide means are in their most compressed position so that the sleeves, which are capable of elastic extension, will be subjected to extension with elastic stretching only when the slide means are working.

2. A displacement pump as claimed in claim 1, wherein the supply means for the medium includes a funnel, a suction valve means inside said funnel, which valve means incorporates a slide component, and power means connected to said slide component for moving the slide component between an open position in which said slide component is positioned at a distance from the walls of the funnel and a closed position in which said slide component is forced against the walls of the funnel, said power means being controlled in such a manner as to maintain the slide component in its open position during the suction stroke and to maintain the slide component in its closed position during the compression stroke of the slide means.

3. A displacement pump as claimed in claim 2, wherein the slide component is disposed to move essentially vertically in the funnel and said funnel is open towards the top, so that said slide component acts not only as a valve body, but also as a ram for forcing down the medium which is poured into the funnel.

* * * * *